US007311147B2

(12) United States Patent
Sweatman et al.

(10) Patent No.: US 7,311,147 B2
(45) Date of Patent: Dec. 25, 2007

(54) METHODS OF IMPROVING WELL BORE PRESSURE CONTAINMENT INTEGRITY

(75) Inventors: Ronald E. Sweatman, Montgomery, TX (US); Hong Wang, Spring, TX (US); Wolfgang F. J. Deeg, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 11/430,305

(22) Filed: May 4, 2006

(65) Prior Publication Data

US 2006/0266519 A1 Nov. 30, 2006

Related U.S. Application Data

(60) Division of application No. 10/350,429, filed on Jan. 24, 2003, which is a continuation-in-part of application No. 10/082,459, filed on Feb. 25, 2002, now Pat. No. 6,926,081.

(51) Int. Cl.
*E21B 43/26* (2006.01)

(52) U.S. Cl. ..... 166/283; 166/250.1; 166/250.14; 166/295; 166/308.5; 73/152.51

(58) Field of Classification Search ..... None
See application file for complete search history.

(56) References Cited

U.S. PATENT DOCUMENTS

| | | | |
|---|---|---|---|
| 3,615,794 | A | 10/1971 | Nimerick |
| 3,846,310 | A | 11/1974 | Blackwell et al. |
| 3,960,082 | A | 6/1976 | Sloevsky et al. |
| 4,152,941 | A | 5/1979 | Abou-Sayed et al. |
| 4,173,999 | A | 11/1979 | Messenger |
| 4,434,848 | A | 3/1984 | Smith |
| 4,498,995 | A | 2/1985 | Gockel |
| 4,714,115 | A | 12/1987 | Uhri |
| 4,718,490 | A | 1/1988 | Uhri |
| 4,836,940 | A | 6/1989 | Alexander |
| 4,838,352 | A | 6/1989 | Oberste-Padtberg et al. |
| 4,930,575 | A | 6/1990 | Falk |
| 5,180,020 | A | 1/1993 | Fuh et al. |
| 5,207,282 | A | 5/1993 | Fuh et al. |
| 5,222,048 | A | 6/1993 | Grosso et al. |
| 5,253,709 | A | 10/1993 | Kendrick et al. |
| 5,275,041 | A | 1/1994 | Poulsen |
| 5,285,692 | A | 2/1994 | Steiger et al. |
| 5,335,726 | A | 8/1994 | Rodrigues |
| 5,358,051 | A | 10/1994 | Rodrigues |
| 5,472,049 | A | 12/1995 | Chaffee et al. |
| 5,482,116 | A | 1/1996 | El-Rabaa et al. |
| 5,489,740 | A | 2/1996 | Fletcher |
| 5,497,831 | A | 3/1996 | Hainey et al. |
| 5,555,945 | A | 9/1996 | Schultz et al. |
| 5,836,392 | A | 11/1998 | Urlwin-Smith |
| 5,868,030 | A | 2/1999 | Brumley et al. |
| 5,873,413 | A | 2/1999 | Chatterji et al. |
| 5,881,826 | A | 3/1999 | Brookey |
| 5,890,536 | A | 4/1999 | Nierode et al. |
| 5,913,364 | A | 6/1999 | Sweatman |
| 5,934,377 | A | 8/1999 | Savage |
| 5,945,387 | A | 8/1999 | Chatterji et al. |
| 5,964,293 | A | 10/1999 | Chatterji et al. |
| 5,969,006 | A | 10/1999 | Onan et al. |
| 6,012,524 | A | 1/2000 | Chatterji et al. |
| 6,059,035 | A | 5/2000 | Chatterji et al. |
| 6,059,036 | A | 5/2000 | Chatterji et al. |
| 6,060,434 | A | 5/2000 | Sweatman et al. |
| 6,123,159 | A | 9/2000 | Brookey et al. |
| 6,148,917 | A | 11/2000 | Brookey et al. |
| 6,156,708 | A | 12/2000 | Brookey et al. |
| 6,167,967 | B1 | 1/2001 | Sweatman |
| 6,186,230 | B1 | 2/2001 | Nierode |
| 6,189,612 | B1 | 2/2001 | Ward |
| 6,192,986 | B1 | 2/2001 | Urlwin-Smith |

(Continued)

FOREIGN PATENT DOCUMENTS

| | | |
|---|---|---|
| WO | WO 96/32567 A1 | 10/1996 |
| WO | WO 01/40617 A1 | 6/2001 |
| WO | WO 01/98626 A1 | 12/2001 |
| WO | WO 01/98627 A1 | 12/2001 |

OTHER PUBLICATIONS

Paper titled "Principles for Fracture Design Based on Pressure Analysis" by K.G. Nolte, dated 1988. (Original SPE manuscript received for review May 11, 1982. Paper (SPE 10911) first presented at the SPE Cotton Valley Symposium held in Tyler Texas May 20, 1982.).

SPE 28555 titled "Oriented Preforations—A Rock Mechanics View" by Hazim A. Abass et al., dated 1994.

ETCE98-4656 titled "Borehole Failure Resulting From Formation Integrity (Leak-Off) Testing in Upper Marine Sediments Offshore" by Andrew K. Wojtanowicz et al., dated 1998.

ETCE99-6645 titled "Solutions Proposed for Deepwater Drilling Challenges Using New Technology for Hole-Stabilization-While-Drilling" by Roland Sweatman et al., dated 1999.

(Continued)

*Primary Examiner*—Zakiya W. Bates
(74) *Attorney, Agent, or Firm*—Craig W. Roddy; Haynes & Boone, LLP

(57) ABSTRACT

Methods of improving the pressure containment integrity of subterranean well bores are provided. The methods include pumping a fracture sealing composition into the well bore that rapidly converts into a high friction pressure sealing composition which is impermeable, deformable, extremely viscous and does not bond to the faces of fractures. Thereafter, the fracture sealing composition is squeezed into one or more natural fractures or into one or more new fractures formed in the well bore to thereby increase the pressure containment integrity of the well bore. The methods also include the prediction of the expected increase in pressure containment integrity.

30 Claims, 1 Drawing Sheet

U.S. PATENT DOCUMENTS

| | | | | |
|---|---|---|---|---|
| 6,196,317 | B1 | 3/2001 | Hardy | |
| 6,237,688 | B1 | 5/2001 | Burleson et al. | |
| 6,251,990 | B1 | 6/2001 | Meguriya et al. | |
| 6,258,757 | B1 | 7/2001 | Sweatman et al. | |
| 6,271,181 | B1 | 8/2001 | Chatterji et al. | |
| 6,328,106 | B1 | 12/2001 | Griffith et al. | |
| 6,356,205 | B1 | 3/2002 | Salvo et al. | |
| 6,367,549 | B1 | 4/2002 | Chatterji et al. | |
| 6,374,925 | B1 | 4/2002 | Elkins et al. | |
| 6,390,208 | B1 | 5/2002 | Brookey | |
| 6,401,817 | B1 | 6/2002 | Griffith et al. | |
| 6,401,818 | B1 | 6/2002 | Papanastasiou | |
| 6,448,206 | B1 | 9/2002 | Griffith et al. | |
| 6,456,902 | B1 | 9/2002 | Streetman | |
| 6,460,619 | B1 | 10/2002 | Braithwaite et al. | |
| 6,503,870 | B2 | 1/2003 | Griffith et al. | |
| 6,555,507 | B2 | 4/2003 | Chatterji et al. | |
| 6,561,273 | B2 | 5/2003 | Brothers et al. | |
| 6,710,019 | B1 * | 3/2004 | Sawdon et al. | 507/136 |
| 6,739,414 | B2 | 5/2004 | Brookey et al. | |
| 6,837,313 | B2 | 1/2005 | Hosie et al. | |
| 6,926,081 | B2 | 8/2005 | Sweatmant et al. | |
| 7,013,995 | B2 | 3/2006 | Crawshaw et al. | |
| 7,213,645 | B2 | 5/2007 | Sweatman et al. | |
| 2002/0092654 | A1 | 7/2002 | Coronado et al. | |
| 2002/0112888 | A1 | 8/2002 | Leuchtenberg | |
| 2003/0045434 | A1 | 3/2003 | Brothers et al. | |
| 2003/0146001 | A1 | 8/2003 | Hosie et al. | |
| 2004/0069538 | A1 | 4/2004 | Reddy et al. | |
| 2004/0171496 | A1 | 9/2004 | Growcock et al. | |
| 2004/0214725 | A1 | 10/2004 | Moss | |
| 2005/0003967 | A1 | 1/2005 | Rea et al. | |

OTHER PUBLICATIONS

IADC/SPE 59131 titled "Improved Zonal Isolation Through the Use of Sealants Before Primary Cementing Operations" by Loyd E. East, Jr., et al., dated 2000.

Paper titled "How to Choose Between Mud and Cement Inflation of Inflatable Packers" by George O. Suman, Jr. et al., dated 1995.

IADC/SPE 59132 titled "New Cement Systems for Durable Zonal Isolation" by Le Roy-Delage S. et al., dated 2000.

SPE 20409 titled "Theory of Lost Circulation Pressure" by N. Morita et al., dated 1990.

SPE/IADC 67735 titled "Lost Circulation Control: Evolving Techniques and Strategies to Reduce Downhole Mud Losses" by James R. Bruton et al., dated 2001.

SPE 68946 titled "Formation Pressure Integrity Treatments Optimize Drilling and Completion of HTHP Production Hole Sections" by Ronald W. Sweatman et al., dated 2001.

SPE 73177 titled "Aphron-Base Drilling Fluid: Evolving Technologies for Lost Circulation Control" by C.D. Ivan et al., dated 2001.

SPE 71390 titled "New Treatments Substantially Increase LOT/FIT Pressures to Solve Deep HTHP Drilling Challenges" by Sid Webb et al., dated 2001 (*Including copies of PowerPoint slides and outline for corresponding PowerPoint presentation*).

IADC/SPE 74518 titled "Unique Crosslinking Pill in Tandem With Fracture Prediction Model Cures Circulation Losses in Deepwater Gulf of Mexico" by Douglas E. Caughron et al., dated 2002.

AADE 01-NC-HO-42 titled "Treatments Increase Formation Pressure Integrity in HTHP Wells" by Scott Kelley et al., dated 2001.

Paper titled "Drill ahead to complete HP/HT wells" by Scott Kelley et al., Hart's E & P, Sep. 2001, pp. 87-89, Chemical Week Associates, New York, NY.

Paper titled "Fracture Evaluation Using Pressure Diagnostics" by Sunil N. Gulrajani et al., Reservoir Stimulation, Jun. 2000, pp. 9-1 to 9-63, John Wiley & Sons, Inc., Hoboken, NJ.

Brochure titled "Novel lost circulation treatment," Instanseal Brochure, dated 2000.

SPE 24599 titled "A New Approach to Preventing Lost Circulation While Drilling" by Giin-Fa Fuh et al., dated 1992.

SPE/IADC 37671 titled "New Solutions to Remedy Lost Circulation, Crossflows, and Underground Blowouts" by Ronald Sweatman et al., dated 1997.

SPE 53312 titled "Conformance-While-Drilling Technology Proposed to Optimize Drilling and Production" by Ron Sweatman et al., dated 1999.

SPE 52188 titled "Novel Approach to Borehole Stability Modeling for ERD and Deepwater Drilling" by U.A. Tare et al., dated 1999.

Paper titled "Conformance-While-Drilling (CWD) Technology Proposed to Optimize Drilling and Production" by Ron Sweatman et al., dated 1999.

SPE 56598 titled "High Propagation Pressures in Transverse Hydraulic Fractures: Cause, Effect, and Remediation" by W.F.J Deeg, dated 1999.

OTC 11976 titled "New Chemical Systems and Placement Methods to Stabilize and Seal Deepwater Shallow-Water Flow Zones" by Larry Eoff et al., dated 2000.

SPE 71368 titled "Drilling Fluid Losses and Gains: Case Histories and Practical Solutions" by Uday A. Tare et al., dated 2001.

Paper entitled "Remote Real Time Operations Assists in the Success of Wellbore Stability Solutions," by D. Kulakofsky et al., presented at the Nov. 13-15, 2002 XIV Deep Offshore Technology Conference and Exhibition in New Orleans, Louisiana.

Paper entitled "The Difference between Fracture Gradient and Wellbore Pressure Containment and the Effect of Drilling Beyond Natural Limits" by Hong Wang et al., presented at the AADE 2003 National Technology Conference "Practical Solutions for Drilling Challenges," Apr. 1-3, 2003 in Houston, Texas.

Paper entitled "New Solutions for Subsalt-Well Lost Circulation and Optimized Primary Cementing," SPE 56499, by R. Sweatman, R. Faul and C. Ballew, presented at the 1999 SPE Annual Technical Conference, Oct. 3-6, 1999 in Houston, Texas.

Paper entitled "In-Situ Reactive System Stops Lost Circulation and Underground Flow Problems in Several Southern Mexico Wells," SPE 59059, by F. Rueda and R. Bonifacio, presented at the 2000 International Petroleum Conference and Exhibition, Feb. 1-3, 2000 in Villahermosa, Mexico.

Paper titled "Clay/latex mixture stops circulation in large Carbonate fractures," by Boris Kurochkin, Oil & Gas Journal, Aug. 28, 1995.

Paper titled "Formation of Vertical Fractures by Means of Highly Viscous Liquid" by S.A. Khristianovic and U.P. Zheltov; Proceedings Fourth World Petroleum Congress, Section II/T.O.P., Paper 3; pp. 579-585.

Paper titled "A Rapid Method of Predicting Width and Extent of Hydraulically Induced Fractures" by J. Geertsma and F. de Klerk; Journal of Petroleum Technology, Dec. 1969; pp. 1571-1581.

Paper titled "Widths of Hydraulic Fractures" by T.K. Perkins, L.R. Kern, Members AIME; Journal of Petroleum Technology, Sep. 1961; pp. 937-949.

Paper titled "Propagation of a Vertical Hydraulic Fracture" by R.P. Nordgren; Society of Petroleum Engineers Journal, Aug. 1972; pp. 306-314.

Paper titled "The Opening of a Griffith Crack Under Internal Pressure" by I.N. Snedden and H.A. Elliott; vol. IV. No. 3; pp. 262-267.

Paper titled "Some Two-Dimensional Punch and Crack Problems in Classical Elasticity" by A.H. England and A.E. Green; Proc. Comb. Phil. Soc. (1963); pp. 489-500.

Paper titled "The Opening of a Pair of Coplanar Griffith Cracks Under Internal Pressure" by C.J. Tranter; 1960; pp. 283-292.

Paper titled "The Effect of Non-Uniform Internal Pressure on Crack-Extension in an Infinite Body" by E. Smith; Int. J. Engng. Sci. vol. 4, 1966; pp. 671-679.

* cited by examiner

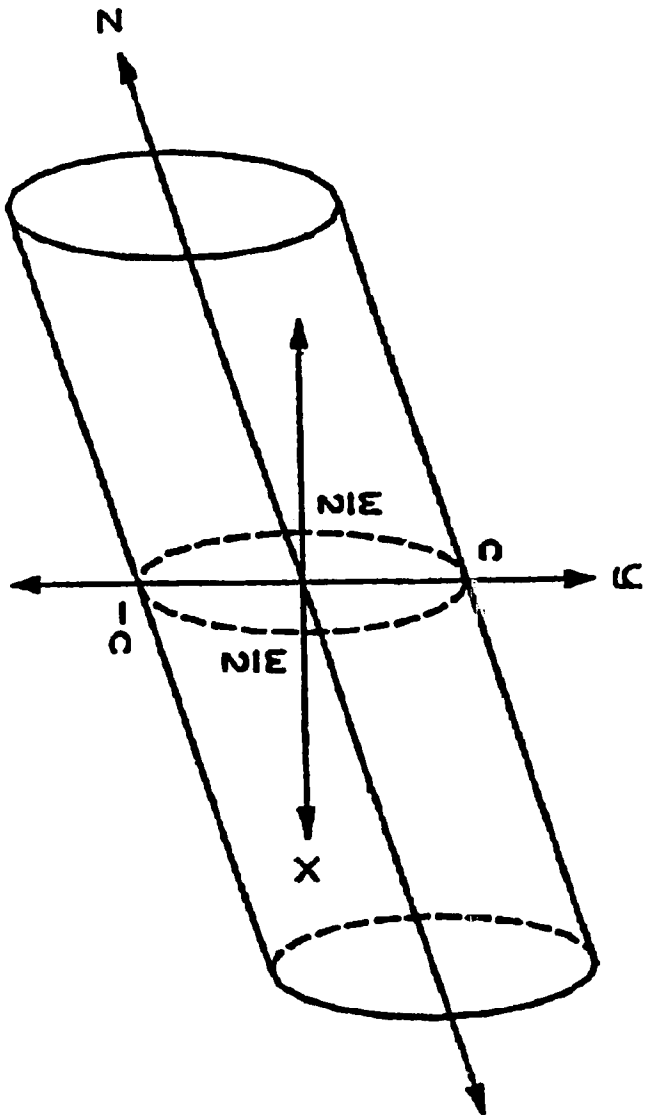
y
c
z
-c
x
z/2
z/2

METHODS OF IMPROVING WELL BORE PRESSURE CONTAINMENT INTEGRITY

CROSS-REFERENCES TO RELATED APPLICATIONS

This Application is a Division of application Ser. No. 10/350,429, filed Jan. 24, 2003, which is a Continuation-In-Part of application Ser. No. 10/082,459 filed Feb. 25, 2002 (now U.S. Pat. No. 6,926,081 B2).

BACKGROUND OF THE INVENTION

1. Field of the Invention

The present invention relates to methods of improving the pressure containment integrity of subterranean well bores containing drilling fluids or completion fluids.

2. Description of the Prior Art

In the drilling of wells (for example, oil and gas wells) using the rotary drilling method, drilling fluid is circulated through a drill string and drill bit and then back to the surface by way of the well bore being drilled. The drilling fluid maintains hydrostatic pressure on the subterranean formations through which the well bore is drilled to thereby prevent pressurized formation fluid from entering the well bore and to circulate cuttings out of the well bore. When the well bore reaches the top of the producing interval, a permeability damage reducing completion fluid is placed in the well bore and the producing interval is drilled using the completion fluid.

Once the well bore has been drilled to the desired depth, a string of pipe referred to as casing is positioned in the well bore. A hydraulic cement composition is pumped into the annular space between the walls of the well bore and the casing and allowed to set thereby forming an annular sheath of hardened substantially impermeable cement in the annulus. The cement sheath physically supports and positions the casing in the well bore and bonds the casing to the walls of the well bore whereby undesirable migration of fluids between zones or formations penetrated by the well bore is prevented.

The subterranean formations into or through which well bores are drilled often contain naturally occurring or drilling induced weak zones having low tensile strengths and/or openings such as natural fractures, faults and high permeability streaks through which drilling fluid is lost from the well bores or pressurized formation fluids enter the well bores. The drilling of additional well bores in producing fields often requires drilling through pressure depleted production zones that are weakened by pore pressures much lower than the original reservoir pressure. The weak zones in the well bores have low pressure containment integrity and are subject to failure as a result of the hydrostatic pressure exerted on them by drilling fluids or other treating fluids such as hydraulic cement slurries. That is, when a well fluid such as drilling fluid or a hydraulic cement slurry is introduced into the well bore, the combination of hydrostatic and friction pressure exerted on the walls of the well bore can exceed the strength of weak zones in the well bore and cause well bore fluid outflows into the formation containing the well bore. When the formation contains induced or natural formation fractures, faults or the like, well bore fluid outflows and/or pressurized formation fluid inflows, or both, can take place.

In addition, formation sands and shales having unexpected low well bore pressure containment integrity can be encountered while drilling. Thus, at any depth during the drilling or completion of a well bore, the well bore fluid circulating densities and pressures can exceed planned or designed densities and pressures. The excess pressure exerted within the well bore can and often does exceed the subterranean formation's well bore pressure containment integrity which causes outflow and loss of well bore fluids into the formation. Outflow pathways into the formation are opened over time (usually hours) to large dimensions that may contain losses many times the volume of the well bore fluids. Such losses can require substantial volumes of fluids to be pumped into the well bore in an attempt to maintain enough fluid column hydrostatic pressure to control pressurized formation fluids. Conventional plugging systems often fail to seal the outflow pathways and are also lost into the formation. In some cases, the loss rates may be higher than the pump-in rates causing lower fluid column heights in the well bore, reduced hydrostatic pressure below formation pore pressures and pressurized formation fluid inflow. In those cases, emergency measures are needed to contain the inflow at the surface and maintain well pressure control. Accordingly, when the first signs of poor well bore pressure containment integrity appear, rig operators are often forced to prematurely set casing or run a liner in the well bore. In many cases plugging back the well must be accomplished to allow casing to be set or to drill an adjacent sidetrack or bypass well bore. Each of these steps makes the overall cost of the well much higher than expected.

Thus, there are needs for reliable and quick methods of improving the pressure containment integrity of subterranean well bores during drilling.

SUMMARY OF THE INVENTION

The present invention provides methods of discovering, diagnosing and correcting low formation integrity problems during the drilling of successive subterranean well bore intervals. A method of the invention for improving the pressure containment integrity of a subterranean well bore interval containing a drilling fluid or a completion fluid and having a low integrity formation or zone therein is comprised of the following steps. A fracture sealing composition is pumped into the well bore through the drill pipe from the surface to a short distance above the low integrity formation or zone. After exiting the drill pipe, the fracture sealing composition converts into agglutinated masses that channel or finger flow through the well fluid into one or more natural fractures in the well bore or into one or more new generally small fractures formed in the well bore interval. The fracture sealing composition agglutinated masses which are impermeable, deformable, cohesive, extremely viscous and do not bond to the faces of the fractures are squeezed into the fractures to thereby increase the pressure containment integrity of the well bore. The fracture sealing composition causes a near well bore widening of the fractures hereinafter referred to as the "wedge effect" which is the mechanism for the integrity increase.

If it is determined that the well bore fluid is being lost or if pressurized formation fluid is flowing into the well bore either before, during, or after the fracture sealing composition treatment, a selected pumpable sealing composition or application specific drilling fluid pill is provided for intermediate or secondary sealing of the drilled well bore interval to prevent well bore fluid loss therefrom and/or to overbalance and prevent pressurized formation fluid flow into the well bore. If it is determined that the pressure containment integrity is too low, the above described method for improving the pressure containment integrity is performed in the well bore.

Another method of this invention for improving the pressure containment integrity in successively drilled subterranean well bore intervals containing a drilling fluid or a completion fluid is comprised of the following steps. The pressure containment integrity of a first drilled well bore interval is determined. If it is determined that the pressure containment integrity is inadequate in the initial well bore interval, a fracture dimension and wedge effect simulation software and other calculations are performed to determine the feasibility of a fracture sealing composition to increase the pressure containment integrity. This analysis also helps the operator select a fracture sealing composition with required properties such as rapid friction pressure development. The selected fracture sealing composition is pumped into the well bore through the drill pipe from the surface to a short distance above the low pressure containment integrity formation or zone. After exiting the drill pipe, the fracture sealing composition converts into agglutinated masses that channel or finger flow through the well fluid into one or more natural fractures in the well bore interval or into one or more new generally small fractures in the well bore interval. The fracture sealing composition agglutinated masses which are impermeable, deformable, cohesive, extremely viscous and do not bond to the faces of the fractures are squeezed into the fractures to thereby increase the pressure containment integrity of the well bore. As a result the near well bore portion of the fractures are widened which brings about a pressure containment integrity increase. After cleaning out any remaining fracture sealing composition from the well bore, a pressure containment measurement test is performed to confirm the designed increase in integrity. The process is repeated if only a partial increase is obtained. The drilling of the next interval is completed after achieving the designed integrity increase. Well bore logs are then run and relevant data in real time are collected relating to the next well bore interval and to the pressure containment integrity of the well bore interval. Thereafter, if needed, fracture simulation analysis and wedge calculations are made and a fracture sealing composition is placed in the one or more fractures to thereby increase the pressure containment integrity of the second well bore interval. The second interval is then pressure tested and the above described steps are repeated for each additional drilled well bore interval until the total well depth is reached.

The objects, features and advantages of the present invention will be readily apparent to those skilled in the art upon a reading of the description of preferred embodiments which follows when taken in conjunction with the accompanying drawing.

BRIEF DESCRIPTION OF THE DRAWING

The drawing illustrates a fracture extending along the y-axis perpendicular to the well bore. The well bore is located at the center of the fracture and aligned with the z-axis.

DESCRIPTION OF PREFERRED EMBODIMENTS

In the drilling of wells, subterranean zones are often encountered which contain high incidences of weak zones, natural fractures, faults, high permeability streaks and the like through which well bore fluid outflows and pressurized formation fluid inflows can take place. As a result, drilling fluid circulation is sometimes lost which requires termination of the drilling operation. In addition to lost circulation, pressurized fluid inflows are often encountered which cause cross-flows or underground blowouts whereby formation fluids flow into the well bore. These problems which may be difficult to define at the surface often force the discontinuance of drilling operations and the implementation of remedial procedures that are of long duration and high costs.

A variety of methods and compositions have been developed and used for dealing with the above described problems. Unfortunately those methods and compositions are often unsatisfactory. Even when successful, adequate increases in the pressure containment integrity of the well bore are often not achieved. Prior to the present invention there has not been an effective technique available for discovering, diagnosing and correcting subterranean formation integrity problems of the types described above during the drilling of a well bore.

In order to prevent the high cost and downtime associated with remedial procedures to restore lost circulation or solve other well bore problems, drilling rig operators are often forced to divert from their initial drilling plan. For example, the rig operators are frequently required to prematurely set casing in order to avoid well bore fluid outflows, pressurized formation fluid inflows and pressure containment integrity problems. These measures increase the costs of well construction, increase the time to completion and may also limit the well productivity due to restricted pipe diameters, the inability to reach desired reservoir depths and the like.

The methods of the present invention allow rig operators to discover, diagnose and correct formation integrity problems in successively drilled subterranean well bore intervals. That is, after drilling each well bore interval having a length in the range of from about 250 feet to about 5,000 feet, the drilling is temporarily stopped while tests are run and well logs and other relevant well data are collected and analyzed. If the test results and collected data indicate that one or more problems exist in the drilled well bore interval, remedial steps are taken to correct the problems after which the next well bore interval is drilled, tested, data collected, etc. This process of well bore interval drilling and discovering, diagnosing, and correcting formation integrity problems in each well bore interval is continued until the total well bore depth is reached. Thereafter, the well bore can be completed and placed on production without the occurrence of problems associated with formation integrity.

It has been discovered that improving the pressure containment integrity of a well bore, i.e., improving the capacity of the well bore to contain higher well bore pressure, can be accomplished by altering the geometry of the well bore. This is accomplished in accordance with the present invention by sealing the well bore with a high friction pressure producing fracture sealing composition that enters one or more natural fractures in the well bore or forms and enters one or more new generally small fractures therein or both. As a result, the circular well bore is changed into a well bore having one or more hydraulically induced fractures emanating therefrom. The fractures are sealed a distance from the well bore with a fracture sealing composition which is impermeable, deformable, extremely viscous and does not bond to the faces of the fractures. That is, the pressure containment of the fractures is increased by isolating the tips of the fractures from the higher pressure well bore region using a wedge of the fracture sealing composition described above which arrests fracture extension.

After the fracture sealing composition is reamed by the drill bit during the post-treatment hole cleaning, the hole shape may appear to be circular even though the rock has been deformed by the wedge shaped sealing composition placed in the fractures. The presence of the fractures containing the deformable, impermeable, high friction pressure and nonbonded sealing composition provides higher well bore pressure containment in the well bore as is further explained below.

When a well bore is drilled utilizing the rotary drilling method, the well bore produced is approximately circular. A tensile failure of the well bore can occur when the pressure in the well bore overcomes the compressive tangential stress around the well bore and the rock's tensile strength. However, the rock normally has a compressive strength much higher than the tensile strength. After the shape of the well bore is modified by one or more fractures as described above, the width of the sealed fractures can change in accordance with well bore pressure changes. That is, the hydrostatic pressure in the well bore and in the fractures induces normal stresses in the formation immediately adjacent to the fracture faces that are compressive rather than tensile. This effectively eliminates the creation of secondary fractures normal to the fracture faces. While the stress at the fracture tips is tensile stress, the deformable and impermeable sealing composition within the fracture near the well bore creates friction along the fracture faces and prevents the pressure from being transmitted from the well bore to the fracture tips thereby effectively arresting the fractures and preventing their extension. As a result, the well bore containing the one or more sealed fractures is capable of containing significantly higher hydrostatic pressure.

A method of this invention for improving the pressure containment integrity of a well bore penetrating a subterranean formation basically comprises the steps of propagating at least one fracture into the subterranean formation and then placing a fracture sealing composition in the fracture. The sealing composition is placed in a portion of the fracture between the well bore and the tip of the fracture.

Another method of this invention for improving the pressure containment integrity in successively drilled subterranean well bore intervals containing a drilling fluid or a completion fluid is comprised of the following steps. The pressure containment integrity of the first drilled well bore interval is determined as will be described further hereinbelow. If it is determined that the pressure containment integrity is inadequate in the well bore interval, well bore logs are run and relevant data are collected and analyzed in real time. A fracture sealing composition is then pumped into the well bore interval whereby it enters one or more natural fractures in the well bore interval or forms and enters one or more new generally small fractures in the well bore interval or both. The fracture sealing composition rapidly converts into a high friction pressure sealant agglutinate which is impermeable, deformable, cohesive, extremely viscous and does not bond to the faces of fractures. The agglutinated fracture sealant composition is squeezed into the natural and formed fractures to thereby increase the pressure containment integrity of the well bore. A near well bore widening of the fractures, i.e., the wedge effect, is the mechanism that causes the pressure containment integrity increase. After cleaning out any remaining fracture sealing composition from the well bore, a pressure containment integrity measurement test is performed to confirm the designed increase in the pressure containment integrity. The process is repeated if only a partial increase is obtained.

After achieving the designed pressure containment integrity increase, the next well bore interval is drilled. Well bore logs are then run and relevant data in real time are collected relating to the next well bore interval and to the pressure containment integrity of the next well bore interval. If needed, fracture simulation analysis and wedge calculations are made and a fracture sealing composition is squeezed into one or more fractures in the second well bore interval to thereby increase the pressure containment integrity of the second well bore interval. The second well bore interval is then pressure tested. Thereafter, the steps described above are repeated for each additional drilled well bore interval until the total well depth is reached.

Before beginning the well bore drilling process, all well log data and other relevant well data relating to previous wells drilled in the area are studied and reviewed to determine problem areas that may be encountered and identify or formulate possible solutions for correcting the problems upon commencing the drilling of the new well bore.

After drilling the first well bore interval in accordance with the above described method, drilling is suspended for a short time period and tests are conducted. In one of the tests, the pressure containment integrity of the drilled well bore interval is determined. In that test, a well bore fluid such as drilling fluid or completion fluid in the well bore interval is pressurized to an equivalent well bore fluid weight greater than or equal to the maximum hydrostatic pressure and friction pressure level expected to be exerted during continued drilling operations in the drilled well bore interval to determine if the pressure containment integrity of the drilled well bore interval is adequate. If the pressurized well bore fluid in the well bore interval leaks off into the subterranean formation containing the well bore interval before reaching the maximum equivalent well bore fluid column weight, the pressure containment integrity of the well bore is inadequate.

During the drilling of the well bore interval and prior to the pressure containment integrity test, drilling fluid gain or loss data are analyzed to determine if well bore fluid is being lost or if pressurized formation fluid is flowing into the well bore interval or both. If this analysis indicates that well bore fluid is being lost or if pressurized formation fluid is flowing into the well, the location of the outflows or inflows are determined. Thereafter, a specific sealing composition for use in sealing the well bore interval to prevent further outflow of well bore fluid or inflow of formation fluid is determined. The determined specific sealing composition is then utilized to seal the areas of outflow and/or inflow in the well bore usually before the fracture sealing composition treatment to increase pressure containment integrity. However, the sealing of outflows or inflows are occasionally conducted during and after the fracture sealing composition treatment.

As mentioned, well bore logs are run and data in real time are collected relating to the pressure containment integrity of each well bore interval and if needed, a fracture sealing composition which when placed downhole becomes impermeable, deformable, extremely viscous, and does not bond to the faces of the fractures is determined and utilized. Examples of the data that can be collected and used include, but are not limited to, leak-off test data, electronic log data, formation cuttings, chemical composition analyses and various stimulation models well known to those skilled in the art. In addition to the type and volume of sealing composition required, an analysis of the data determines the sealing composition placement parameters such as rates, pressures, volumes, time periods, densities, sealant properties, etc.

Various sealing compositions which rapidly convert downhole into agglutinates that are impermeable, have extremely high viscosity, are deformable and do not bond to the faces of formed fractures can be utilized for sealing the one or more fractures formed in the well bore in accordance with this invention. An example of a suitable sealing composition that can be used and that reacts with water and chemical components of water based fluids or with delayed set sealants or formation waters in the well bore is basically comprised of a non-aqueous fluid such as synthetic, mineral, vegetable, or hydrocarbon oils, a hydratable polymer, a polymer cross-linking agent and a water swellable clay. This sealing composition is described in detail in U.S. Pat. No. 6,060,434 issued to Sweatman et al. on May 9, 2000, which is incorporated herein by reference thereto.

Another sealing composition which reacts with water and chemical components of water based fluids or with delayed set sealants or formation waters in the well bore can be utilized in accordance with the present invention which rapidly converts downhole into agglutinates that are impermeable, have extremely high viscosity, are deformable and do not bond to the faces of fractures is comprised of a non-aqueous fluid such as oil, synthetic oil or a blend thereof, a dry powder mixture of hydratable clays and cross-linkable polymers, a surfactant and a cross-linking catalyst. The non-aqueous fluid can be any of a variety of fluids including synthetic fluids, mineral oils, vegetable oils, hydrocarbon oils and synthetic oils such as esters in individual amounts or mixtures thereof. The non-aqueous fluid included in the sealing composition can present in an amount in the range of from about 15 gallons per barrel to about 31 gallons per barrel of the sealing composition. The dry powder mixture of hydratable clays and cross-linkable polymers is present in the sealing composition in an amount in the range of from about 220 pounds per barrel to about 400 pounds per barrel of the composition. The surfactant in the sealing composition can be any of various viscosity thinning surfactants, e.g., the condensation reaction product of acetone, formaldehyde and sodium sulfite and is present therein in an amount in the range of from about 0 gallons per barrel to about 2 gallons per barrel of the composition. Finally, the catalyst in the sealing composition is any of a variety of polymer cross-linking agents such as multivalent metal salts or salt releasing compounds and is present in the composition in an amount in the range of from about 0.1% to about 3% by weight of the composition.

A sealing composition that reacts with both aqueous and non-aqueous fluids, with other chemical components in emulsion based fluids, with non-emulsified non-aqueous fluids, with delayed set sealants in the well bore or with formation fluids (oil, gas, water, etc.) is basically comprised of water, an aqueous rubber latex, an organophilic clay, sodium carbonate and a latex stabilizing surfactant such as nonylphenyl ethoxylated with 20 to 30 moles of ethylene oxide. This sealing composition is described in detail in U.S. Pat. No. 6,258,757 B1 issued to Sweatman et al. on Jul. 10, 2001, and is also incorporated herein by reference thereto.

Yet another sealing composition that can be utilized and that reacts with aqueous and non-aqueous fluids, with other chemical components in emulsion based fluids, with non-emulsified non-aqueous fluids, with delayed set sealants or with formation fluids (oil, gases, water, etc.) in the well bore is comprised of fresh water, a latex stabilizer, a rubber latex, a defoamer, a viscosity thinning surfactant and a dry powder mixture of organophilic clays. A suitable latex stabilizer is a surfactant comprised of a sodium salt of an ethoxylated (15 moles or 40 moles) $C_{15}$ alcohol sulfonate having the formula $H(CH_2)_{15}(CH_2CH_2O)_{15}SO_3N_a$. The rubber latex stabilizing surfactant is included in the sealing composition in an amount in the range of from about 0% to about 10% by weight of the sealing composition. A variety of rubber latexes can be utilized. A particularly suitable styrene/butadiene aqueous latex has a styrene/butadiene weight ratio of about 25%:75%, and the styrene/butadiene copolymer is suspended in an aqueous emulsion in an amount in the range of from 30% to 60% by weight of the emulsion. The rubber latex is included in the sealing composition in an amount in the range of from about 40% to about 80% by volume of the sealing composition. A particularly suitable defoamer is polydimethylsiloxane and it is present in the sealing composition in an amount in the range of from about 0.8% to about 1.2% by weight of the composition. The viscosity thinning surfactant utilized in the sealing composition functions to provide mixable viscosities with heavy powder loadings. A particularly suitable such viscosity thinning surfactant is the condensation reaction product of acetone, formaldehyde and sodium sulfite which is included in the sealing composition in an amount in the range of from about 0.3% to about 0.6% by weight of the composition. The dry powder mixture of organophilic clays is included in the sealing composition in an amount in the range of from about 80 pounds per barrel to about 300 pounds per barrel of the composition.

The placement of the sealing composition utilized in the one or more fractures formed in a well bore interval can be controlled in a manner whereby portions of the sealing composition are continuously converted into agglutinated sealing masses that are successively diverted into the one or more fractures until all of the fractures are sealed. This is accomplished by pumping the sealing composition through one or more openings at the end of a string of drill pipe into the well bore interval at a flow rate relative to the well bore fluids therein whereby the sealing composition flows through the well bore fluids with controlled mixing therewith and whereby portions of the sealing composition are converted into agglutinated sealing composition masses. The sealing composition masses are squeezed into one or more existing and/or newly formed fractures in the well bore. The sealing masses are successively diverted into and seal the fractures thereby allowing the hydrostatic pressure exerted in the well bore to increase until all of the fractures in the well bore are sealed. This method of utilizing a sealing composition is describe in detail in U.S. Pat. No. 5,913,364 to Sweatman issued on Jun. 22, 1999 which is incorporated herein by reference thereto. The viscous sealing masses have viscosities in the range of from about 1,000 centipoises to about 10,000,000 centipoises.

As will be further understood by those skilled in the art, spacers can be pumped into the well bore interval in front of and/or behind the sealing composition utilized to prevent the sealing composition from reacting and solidifying inside the drill pipe and bottom hole assembly (drill bit, drill collars, LWD/MWD/PWD tools, drill motors, etc.) during placement into one or more fractures to be sealed. The spacers can have densities equal to or greater than the density of the well fluid and the spacers can be chemically inhibited to prevent formation damage.

The fracture sealing compositions utilized can include weighting materials to increase their densities and thereby cause the sealing composition masses to flow through the drilling fluid, completion fluid or other fluid in the well bore, also referred to hereinbelow as "mud", and into the one or more fractures therein. A preferred method is to use a weighted sealing system or a heavy mud pill spot or both to create a sealing composition and mud co-mingled mixture downhole that has a much higher density than the mud present in the well. This higher density mixture has all of the other properties of a sealing composition and mud mixture except it is much heavier compared to mixtures that are currently used. Almost all current sealing composition designs result in a mixture lighter than the mud. Rarely does a sealing composition design have a density higher than the density of the mud in the well and, when it has, it is not more than about 1 pound per gallon heavier. This has heretofore occurred in wells that contain water based muds having less than 9 pounds per gallon density.

A preferred method of this invention uses a sealing composition and mud mixture having a density more than 1 pound per gallon heavier than the density of the well fluid (mud) used to drill or complete the well. The resulting sealing composition and mud mixture's heavier density has gravity and inertia forces enhancing the mixture's flow down the well bore to the bottom. The currently designed lighter density mixtures float in the heavier mud in the well bore which inhibits the mixture's flow to the bottom of the well bore.

Depending on the length of the well bore to the bottom and the well bore diameter, the preferred difference between the sealing composition-mud mixture density and the mud density is from about 1 pound per gallon to about 5 pounds per gallon. Longer and smaller diameter well bores need a sealing composition-mud mixture density between about 2 and about 5 pounds per gallon heavier than the mud. Shorter and larger diameter well bores need a 1-2 pounds per gallon density difference to enhance the heavier mixture's flow to the bottom.

After the fracture sealing composition has been placed in the one or more fractures in the well bore, the well bore fluid containing agglutinated sealing composition masses that have not been diverted into weak zones or fractures in the formation are removed from the well bore. Thereafter, the drilled well bore interval can again be tested for pressure containment integrity to ensure that the well bore interval is properly sealed. In addition, additional electric log data and other data can be collected to determine if the well bore interval has been satisfactorily sealed. Once a well bore interval has been fractured and sealed, another well bore interval is drilled and the above described tests and procedures implemented as necessary.

The fracture sealing compositions useful in accordance with this invention can also include hardenable resins comprised of a resin and catalyst for providing additional strength to the sealing compositions. Also, when a fracture sealing composition is utilized in accordance with this invention, additional sealing composition components can be spotted in the drilling fluid or completion fluid which react with the sealing composition. Examples of such sealing composition components include, but are not limited to, vulcanizing agents, weighting materials, aqueous rubber latexes, hardenable resins, resin catalysts and mixtures thereof. Alternatively, one of many delayed sealant systems such as delayed cross-linking polymer solutions, cement slurries and settable drilling fluids can be spotted in the well bore interval containing one or more fractures prior to the placement of the fracture sealing composition in the fractures so that the delayed sealing composition enters the fractures first. For example, a delayed cross-linking gelled sealant can be spotted in the well bore from the bottom of the well bore to a point above the top of the fractures to thereby enter the fractures ahead of the fracture sealing composition. The delayed cross-linking gelled sealant is designed to set after the fracture sealing composition seals the fracture near the well bore. The gel sealant provides a deep seal inside the fracture to help support and maintain the near well bore seal.

In the practice of the fracture sealing and well bore pressure containment integrity improvement method disclosed herein, those skilled in the art may select other sealing materials to provide similar sealing properties to those described herein. Examples of other sealing materials that can be utilized are listed in the table below along with relevant material properties.

Hardness versus Flexural Modulus (Stiffness)

| Material | Hardness (Shore) | Flexural Modulus, psi |
|---|---|---|
| "ALCRYN ® 3055NC" | 55A | 500 |
| "SANTOPRENE ™ 201-55" | 55A | 1,100 |
| Nitrile Rubber | 60A | 800 |
| "ALCRYN ® 2060BK" | 60A | 800 |
| "KRATON G-7720 ™" | 60A | 2,000 |
| "SANTOPRENE ™ 201-64" | 64A | 2,700 |
| "ALCRYN ® 3065NC" | 65A | 900 |
| Nitrile Rubber | 70A | 1,500 |
| "ALCRYN ® 2070BK" | 70A | 1,200 |
| "SANTOPRENE ™ 201-73" | 73A | 3,600 |
| "ALCRYN ® 3075NC" | 75A | 1,500 |
| Nitrile Rubber | 80A | 2,000 |
| "ALCRYN ® 2080BK" | 80A | 1,800 |
| "SANTOPRENE ™ 201-80" | 80A | 6,600 |
| "TEXIN 985-A ™" | 87A | 3,900 |
| "SANTOPRENE ™ 201-87" | 87A | 15,000 |
| "TEXIN 990-A ™" | 90A | 6,000 |
| "KRATON G-7820 ™" | 90A | 21,500 |
| "HYTREL 4069 ™" | 40D | 8,000 |
| "SANTOPRENE ™ 203-40" | 40D | 21,000 |
| "HYTREL 4556 ™" | 45D | 14,000 |
| "TEXIN 445-D ™" | 45D | 10,000 |
| "HYTREL HTR-5612 ™" | 50D | 18,000 |
| "TEXIN 355-D ™" | 50D | 15,000 |
| "SANTOPRENE ™ 203-50" | 50D | 50,000 |
| "HYTREL 6356 ™" | 63D | 43,500 |
| "TEXIN E-921 ™" | 63D | 59,000 |
| "HYTREL 7246 ™" | 72D | 83,000 |
| "TEXIN E-923 ™" | 73D | 130,000 |
| "HYTREL 8238 ™" | 82D | 175,000 |

As is well understood by those skilled in the art, oil and gas wells are often drilled at remote onshore well sites and offshore well sites. It is difficult for the personnel at the well site to analyze data obtained and to determine the specific treatments required using sealing compositions. In accordance with the methods of this invention, the data collected at the well site can be transmitted in real time to a remote location where the necessary computers and other equipment as well as trained personnel are located. The trained personnel can quickly determine the sealing composition required including placement parameters such as rates, pressures, volumes, time periods, densities, and the like. As a result, a specific sealing composition can be quickly determined and transmitted to the personnel at the well site so that the sealing composition can be quickly provided and the sealing procedure can be carried out.

Once one or more well bore intervals have been fractured and the fractures are sealed in accordance with the present invention, an estimate of the improvement in the pressure containment integrity in the well bore can be calculated as follows.

The pressure containment integrity improvement is achieved by placing a sealing composition wedge of known volume V into a fracture of known length c. In order to estimate the containment integrity pressure improvement, the following are required:

1. Equations based on an assumed fracture geometry describing the width profile of the created fracture (i.e., width of fracture at any point along its length or at any position within the fracture) and the condition under which the fracture will extend.
2. A criterion to establish when the wedge placed in the fracture becomes unstable.

For item 1 above, different fracture geometries can be chosen. Several of them are described in the hydraulic fracturing literature. The main two hydraulic fracture geometry models are the CGD and the PKN models (see References 1 through 4 below). The equations set forth below are based on the CGD fracture geometry (References 1 and 2). This model assumes that the fracture can be approximated as a slit-like fracture or crack extending outward from the well bore along the y axis with the well bore aligned with the z axis as shown in the accompanying drawing.

For this assumed crack geometry with three different regions of crack opening tractions ($T_i$) acting normal to the fracture face (crack opening tractions are defined as "the pressure (P) within the fracture minus the in-situ stress state ($\sigma_{min}$) in the formation"), the width of the fracture as a function of position along the y axis is given by:

$$w(y) = \frac{8\cdot(1-v)\cdot(1+v)\cdot c}{\pi E}\left\{\sqrt{1-\left(\frac{y}{c}\right)^2}\left\{\frac{\pi\cdot T_3}{2} + (T_1-T_2)\cdot\left(\arcsin\left(\frac{c_{ws}}{c}\right) + 2\sum_{n=1}^{\infty}\frac{\sin\left(2n\cdot\arcsin\left(\frac{c_{ws}}{c}\right)\right)\cos\left(2n\cdot\arcsin\left(\frac{y}{c}\right)\right)}{(2n-1)(2n+1)}\right) + (T_2-T_3)\cdot\left(\arcsin\left(\frac{c_b}{c}\right) + 2\sum_{n=1}^{\infty}\frac{\sin\left(2n\cdot\arcsin\left(\frac{c_b}{c}\right)\right)\cos\left(2n\cdot\arcsin\left(\frac{y}{c}\right)\right)}{(2n-1)(2n+1)}\right)\right\} + \frac{y}{c}\left\{(T_1-T_2)\cdot\sum_{n=1}^{\infty}\frac{\sin\left(2n\cdot\arcsin\left(\frac{c_{ws}}{c}\right)\right)\sin\left(2n\cdot\arcsin\left(\frac{y}{c}\right)\right)}{n(2n-1)(2n+1)} + (T_2-T_3)\cdot\sum_{n=1}^{\infty}\frac{\sin\left(2n\cdot\arcsin\left(\frac{c_b}{c}\right)\right)\sin\left(2n\cdot\arcsin\left(\frac{y}{c}\right)\right)}{n(2n-1)(2n+1)}\right\}\right\}.$$

The fracture propagation criterion is given by $$K_I = \sqrt{\pi c}\,T_3 + 2\sqrt{\frac{c}{\pi}}\left\{(T_1-T_2)\arcsin\left(\frac{c_{ws}}{c}\right) + (T_2-T_3)\arcsin\left(\frac{c_b}{c}\right)\right\}.$$

In these equations, the following crack face traction profile is assumed:

$$T = \begin{cases} T_1 = P_{wb} - \sigma_{\min} \text{ for } 0 \le |y| \le c_{ws} \\ T_2 = P_{wedge} - \sigma_{\min} \text{ for } c_{ws} \le |y| \le c_b \\ T_3 = P_{pore} - \sigma_{\min} \text{ for } c_b \le |y| \le c \end{cases}.$$

In these equations, c is the fracture length which is either given or estimated from lost circulation volumes using standard hydraulic fracture models while $c_{ws}$, the wedge starting point, and $c_b$, the wedge end point, are determined based on the well bore pressure, the fracture geometry (i.e., width profile), and the wedge volume.

The following formation characteristics are used in the calculations:

A. The rock's Young's modulus E, Poisson's ratio v, and critical stress intensity factor $K_{IC}$.

B. The formation's minimum in-situ stress ($\sigma_{min}$), the pore pressure ($P_{pore}$) within the formation, and an estimate of the pressure ($P_{wedge}$) with which the wedge pushes back against the formation.

In addition to the fracture equation, a criterion (item 2 above) specifying when the wedge placed in the fracture will fail is required. There are at least two possible such criteria:

a. A bridging criterion that states that the material used to exclude fluid from the fracture tip will propagate into the fracture until it reaches a critical, small width beyond which it can no longer penetrate (width of fracture decreases with distance from the pressure source, i.e., the well bore). The critical or bridging width is determined using laboratory testing or possibly particle size distribution and existing bridging theory. (Ref. 5)

b. A frictional criterion that states that a wedge of a certain length $l_w$ in a fracture of width w can withstand a specific pressure differential ΔP across the wedge (from start near well bore to end of wedge). If that critical pressure differential were exceeded for the specific conditions of length and width, the wedge would become unstable. The functional dependence of differential pressure on wedge length and fracture or slot width is established using appropriate laboratory tests.

The actual pressure improvement is determined in an iterative manner, changing the well bore pressure until all the required constraints are satisfied. These constraints are:

1. The wedge material volume remains constant.
2. The relevant wedge stability criterion is just satisfied.
3. The stress intensity factor at the tip of the fracture does not exceed the critical stress intensity factor value.

The actual equations cited above were derived using first principles from the general equations presented in References 6 through 9.

REFERENCES

1. Khristianovitch, S. A., Zheltov, Y. P.: "Formation of Vertical Fractures by Means of Highly Viscous Liquid," 4th World Petroleum Congress Proceedings Section II, Drilling-Production, Rome, Italy, pp. 579-586, (Jun. 6-15, 1955).
2. Geertsma, J., de Klerk, F.: "A Rapid Method of Predicting Width and Extent of Hydraulically Induced Fractures," SPE 02458-JPT, Vol. 21, pp. 1571-1581, (December 1969).

3. Perkins, T. K., Kern, L. R.: "Widths of Hydraulic Fractures," SPE 00089-JPT, Vol. 13, pp. 937-949, (September 1961).
4. Nordgren, R. P.: "Propagation of a Vertical Hydraulic Fracture," SPE 03009-SPEJ, Vol. 12, pp. 306-314, (August 1972).
5. Sneddon, I. N., Elliott, H. A.: "The Opening of a Griffith Crack Under Internal Pressure," Quarterly of Applied Mathematics, Vol. 4, pp. 262-267, (1946).
6. Morita, N., Black, A. D., Guh, G. F.: "Theory of Lost Circulation Pressure," SPE 20409 presented at the 1990 SPE Annual Technical Conference & Exhibition, New Orleans, La., Sep. 23-26, 1990.
7. England, A. H., Green, A. E.: "Some Two-Dimensional Punch and Crack Problems in Classical Elasticity," Proc. Camb. Phil. Soc., Vol. 59, pp. 489-500, (1963).
8. Tranter, C. J.: "The Opening of a Pair of Coplanar Griffith Cracks Under Internal Pressure," Qu. J. Mech. And Appl. Math., Vol. 14, pp. 283-292, (1961).
9. Smith, E.: "The Effect of a Non-Uniform Internal Pressure on Crack Extension in an Infinite Body," Int. J. Engng. Sci., Vol. 4, pp. 671-679, (1966).

The references identified above are incorporated herein in their entirety by reference thereto.

The procedure utilized to calculate the pressure increase attained in the well bore is as follows:

1. If not known, determine the mechanical properties of the rock (E, v and $K_{IC}$) and the length of the crack.
2. Determine the geometry (width) of the crack at every point in the crack assuming the crack is completely filled with fluid and is at equilibrium. The critical, fully filled fracture propagation pressure is calculated using the $K_I$ equation, setting $K_I=K_{IC}$, and the width profile using the w(y) equation assuming that $T_1=T_2=T_3$.
3. Place a wedge into the fracture. This can be done in several ways depending on the criterion used:
   a. With bridging criterion, determine the bridging location and the volume of the fracture from the well bore wall to the bridging location.
   b. With frictional criterion, use the width and the $K_I$ equations for $T_1>T_2=T_3$ assuming a critical fully filled fracture and, using the fracture propagation pressure determined from the $K_I$ equation in step 2 above, determine the length and then the volume of the wedge for this length (i.e., region 1 extends from the well bore center to the wedge start. The pressure in region 1 is the well bore pressure. Region 2 covers the rest of the fracture).
4. Allow sufficient time for the fluid pressure from the tip of the wedge to the tip of the fracture to decay to formation or pore pressure. During this time a small amount of the wedge material may be squeezed back into the well bore as the fracture partly closes, slightly reducing the wedge volume.
5. Increase the well bore pressure in small, discrete steps to find that pressure at which the relevant wedge stability criterion is no longer satisfied. For these calculations the fracture is split into at least three different pressure regions (the well bore pressure region from the well bore center to the start of the wedge, the wedge region, and the tip region extending from the tip of wedge to the tip of the crack). The net opening tractions are as follows:
   a. In the tip region it is the difference between the pore pressure and the minimum in-situ stress.
   b. In the wedge region it will be the difference between the pressure the wedge exerts on the formation and the minimum in-situ stress (it can be assumed that the two are equal). If there is a functional relationship, the wedge region can be split into additional discrete regions and the calculations performed using more than just three discrete pressure regions. The equations are similar to those presented above.
   c. In the well bore region it will be the difference between the well bore pressure and the minimum in-situ stress.

As the pressure in the well bore and the portion of the fracture from the well bore to the start of the wedge increases, the width of the fracture increases at every point causing the start of the wedge to gradually move away from the well bore wall, reducing the wedge length.

The limiting, maximum allowable well bore pressure is subject to three things that need to be satisfied in these calculations as follows:

a. The wedge failure criterion already mentioned.
b. The wedge volume conservation.
c. A fracture propagation criterion.

A general method that can be utilized to calculate the improvement in the pressure containment integrity of a well bore penetrating one or more subterranean formations drilled in accordance with this invention comprises the following steps. Each of the one or more natural or formed fractures in the well bore containing a wedge of a fracture sealing composition is divided into a first region adjacent to the well bore having a pressure equal to the well bore pressure, a second region comprised of one or more subregions all containing a wedge of a fracture sealing composition and a third region at the tip portion of the fracture having a pressure equal to the pore pressure of the formation containing the fracture. The pressure exerted on the faces of the fractures by the wedges of the fracture sealing composition in the second regions of the fractures is determined. Thereafter, the improvement in the pressure containment integrity of the well bore is predicted by applying a failure criterion to determine if the wedges of the fracture sealing composition are stable or unstable.

The pressures exerted on the faces of the fractures are determined by assumption, estimation or establishment through laboratory testing, and the failure criterion utilized may be but are not limited to a bridging criterion or a functional criterion involving wedge length, normal pressure and fracture width subject to conservation of wedge volume.

The methods of the present invention avoid the various problems encountered by rig operators heretofore. The methods allow formation integrity problems to be discovered, diagnosed and corrected during the drilling of the well bore so that when total depth is achieved, the resulting well bore is devoid of weak zones and openings and has adequate pressure containment integrity to permit well completion procedures to be carried out without the occurrence of costly and time consuming formation integrity problems.

Thus, the present invention is well adapted to carry out the objects and attain the benefits and advantages mentioned as well as those which are inherent therein. While numerous changes to the methods can be made by those skilled in the art, such changes are encompassed within the spirit of this invention as defined by the appended claims.

What is claimed is:

1. A method of improving the pressure containment integrity of a well bore penetrating a subterranean formation comprising the steps of:

(a) propagating at least one fracture into said subterranean formation; and (b) placing a fracture sealing composition in said fracture to thereby increase the pressure containment integrity of said well bore, said fracture sealing composition having the property of rapidly converting into high viscosity sealing masses which are diverted into and cause a near well bore widening of said fracture upon commingling and reacting of said composition with oil, water or other components in said well bore, said sealing masses having viscosities in the range of from about 1,000 centipoises to about 10,000,000 centipoises.

2. The method of claim 1 wherein said fracture sealing composition is placed in a portion of said fracture between said well bore and the tip of said fracture.

3. The method of claim 1 wherein said fracture sealing composition is a viscous water or oil based fluid.

4. The method of claim 1 wherein said fracture sealing composition reacts with water, with chemical components in water based fluids, with delayed set sealants or with formation waters in said well bore and is comprised of a non-aqueous fluid, a hydratable polymer, a polymer cross-linking agent and a water swellable clay.

5. The method of claim 4 wherein said fracture sealing composition further comprises a weighting material for increasing the density of the composition to a density higher than the density of other fluid in the well bore and thereby causing the sealing masses to flow through the other fluid in the well bore and into the fracture therein.

6. The method of claim 1 wherein said fracture sealing composition reacts with water, with chemical components of water based fluids, with delayed set sealants or with formation waters in said well bore and is comprised of a non-aqueous fluid, a dry powder mixture comprising hydratable clays and cross-linkable polymers, a surfactant and a cross-linking catalyst.

7. The method of claim 6 wherein said fracture sealing composition further comprises a weighting material for increasing the density of the composition to a density higher than the density of other fluid in the well bore and thereby causing the sealing masses to flow through the other fluid in the well bore and into the fracture therein.

8. The method of claim 1 wherein said fracture sealing composition reacts with fluids in said well bore and is comprised of water, an aqueous rubber latex, an organophilic clay, sodium carbonate and a latex stabilizing surfactant.

9. The method of claim 8 wherein said fracture sealing composition further comprises a weighting material for increasing the density of the composition to a density higher than the density of other fluid in the well bore and thereby causing the sealing masses to flow through the other fluid in the well bore and into the fracture therein.

10. The method of claim 1 wherein said fracture sealing composition reacts with fluids in said well bore and is comprised of fresh water, a latex stabilizer, a rubber latex, a defoamer, a viscosity thinning surfactant and a dry powder mixture comprising organophilic clays.

11. The method of claim 10 wherein said fracture sealing composition further comprises a hardenable resin including a resin and a catalyst for providing additional strength to the composition.

12. The method of claim 10 wherein said fracture sealing composition further comprises a weighting material for increasing the density of the composition to a density higher than the density of other fluid in the well bore and thereby causing the sealing masses to flow through the other fluid in the well bore and into the fracture therein.

13. The method of claim 1 which further comprises the step of spotting delayed set sealant systems or additional sealing composition components in said well bore which react with said sealing composition.

14. The method of claim 13 wherein said delayed set sealant systems are selected from the group consisting of delayed cross-linking polymer solutions, cement slurries and settable drilling fluids.

15. The method of claim 13 wherein said additional sealing composition components spotted in said well bore are selected from the group consisting of vulcanizing agents, weighting agents, aqueous rubber latexes, hardenable resins and mixtures thereof.

16. A method of improving the pressure containment integrity of a well bore penetrating a subterranean formation comprising the steps of:

(a) propagating at least one fracture into said subterranean formation;

(b) placing a fracture sealing composition in said fracture; and (c) calculating the improvement in the pressure containment integrity of the well bore by:

(i) dividing said fracture into a first region adjacent to said well bore having a pressure equal to the well bore pressure, a second region comprised of one or more sub-regions all containing a wedge of said fracture sealing composition and a third region at the tip portion of the fracture having a pressure equal to the pore pressure of the formation;

(ii) specifying the pressure exerted on the faces of said fracture by said one or more wedges of said fracture sealing composition in said second region of said fracture; and (iii) predicting the improvement in the pressure containment integrity of said well bore by applying a failure criterion to determine if said one or more wedges of said fracture sealing composition are stable or unstable.

17. The method of claim 16 wherein said pressures exerted on the faces of said fracture by said one or more wedges are determined in accordance with step (ii) by assumption, estimation or establishment through laboratory testing.

18. The method of claim 16 wherein the failure criterion utilized in step (iii) is a bridging criterion or a functional criterion involving wedge length, normal pressure and fracture width subject to conservation of wedge volume.

19. A method of improving the pressure containment integrity of a well bore penetrating a subterranean formation comprising the steps of:

(a) pumping a fracture sealing composition into the well bore that rapidly converts into high viscosity sealing masses upon commingling and reacting of said composition with oil, water or other components in said well bore;

(b) propagating at least one fracture into said subterranean formation;

(c) spotting delayed set sealant systems or additional sealing composition components in said well bore which react with said fracture sealing composition; and (d) allowing said sealing masses to be diverted into and cause a near well bore widening of said fracture in said subterranean formation to thereby increase the pressure containment integrity of the well bore.

20. The method of claim 19 wherein said delayed set sealant systems are selected from the group consisting of delayed crosslinking polymer solutions, cement slurries and settable drilling fluids.

21. The method of claim 19 wherein said additional sealant composition components spotted in said well bore are selected from the group consisting of vulcanizing agents, weighting agents, aqueous rubber latexes, hardenable resins and mixtures thereof.

22. The method of claim 19 wherein said fracture sealing composition reacts with water, with chemical components in water based fluids, with delayed set sealants or with formation waters in said well bore and is comprised of a non-aqueous fluid, a hydratable polymer, a polymer cross-linking agent and a water swellable clay.

23. The method of claim 22 wherein said fracture sealing composition further comprises a weighting material for increasing the density of the composition to a density higher than the density of other fluid in the well bore and thereby causing the sealing masses to flow through the other fluid in the well bore and into the fracture therein.

24. The method of claim 19 wherein said fracture sealing composition reacts with water, with chemical components of water based fluids, with delayed set sealants or with formation waters in said well bore and is comprised of a non-aqueous fluid, a dry powder mixture comprising hydratable clays and cross-linkable polymers, a surfactant and a cross-linking catalyst.

25. The method of claim 24 wherein said fracture sealing composition further comprises a weighting material for increasing the density of the composition to a density higher than the density of other fluid in the well bore and thereby causing the sealing masses to flow through the other fluid in the well bore and into the fracture therein.

26. The method of claim 19 wherein said fracture sealing composition reacts with fluids in said well bore and is comprised of water, an aqueous rubber latex, an organophilic clay, sodium carbonate and a latex stabilizing surfactant.

27. The method of claim 26 wherein said fracture sealing composition further comprises a weighting material for increasing the density of the composition to a density higher than the density of other fluid in the well bore and thereby causing the sealing masses to flow through other fluid in the well bore and into the fracture therein.

28. The method of claim 19 wherein said fracture sealing composition reacts with fluids in said well bore and is comprised of fresh water, a latex stabilizer, a rubber latex, a defoamer, a viscosity thinning surfactant and a dry powder mixture comprising organophilic clays.

29. The method of claim 28 wherein said fracture sealing composition further comprises a hardenable resin including a resin and a catalyst for providing additional strength to the composition.

30. The method of claim 28 wherein said fracture sealing composition further comprises a weighting material for increasing the density of the composition to a density higher than the density of other fluid in the well bore and thereby causing the sealing masses to flow through the other fluid in the well bore and into the fracture therein.

* * * * *